US005531627A

United States Patent [19]

Deal

[11] Patent Number: 5,531,627

[45] Date of Patent: Jul. 2, 1996

[54] CARTRIDGE-TYPE WATER BOMB WATER GUN CONVERSION DEVICE

[76] Inventor: Jeffry T. Deal, 278 Goat Hill Rd., Lambertville, N.J. 08530

[21] Appl. No.: 389,713

[22] Filed: Feb. 15, 1995

Related U.S. Application Data

[63] Continuation-in-part of Ser. No. 272,091, Jul. 8, 1994, and Ser. No. 318,138, Oct. 5, 1994.

[51] Int. Cl.[6] ..... A63H 33/00

[52] U.S. Cl. ..... 446/473; 446/186; 446/475; 222/79

[58] Field of Search ..... 446/176, 180, 446/186, 220, 224, 267, 473, 475; 222/78, 79, 212; 434/11, 14, 15; 251/4

[56] References Cited

U.S. PATENT DOCUMENTS 3,486,539 12/1969 Jacuzzi .
3,876,115 4/1975 Venus .
4,121,737 10/1978 Kain .
4,135,559 1/1979 Barnby .
4,212,460 7/1980 Kraft .
4,257,460 3/1981 Paranay et al. .
4,458,830 7/1984 Werding .
4,735,239 4/1988 Salmon et al. .
4,854,480 8/1989 Shindo .
4,890,838 1/1990 Rudell et al. .
4,991,847 2/1991 Rudell et al. .
5,238,149 8/1993 Johnson ..... 222/79
5,288,256 2/1994 Lee et al. .

*Primary Examiner*—Sam Rimell
*Assistant Examiner*—Jeffrey D. Carlson
*Attorney, Agent, or Firm*—Kenneth P. Glynn

[57] ABSTRACT

The cartridge-type water bomb water gun conversion device utilizes a cartridge-type water bomb which can be used by itself to release a burst of water or be inserted into a water gun which can convert the cartridge-type water bomb into a reservoir of pressurized water for discharge through an orifice producing a "squirt" type release. The cartridge-type water bomb has an expandable bladder fixedly attached to frontward and rearward portions of a main housing which effect a shut off valve in a passageway when the frontward and rearward portions are rotated relative to one another. The water gun has a gun housing and a cocking and engaging lever which accepts the cartridge-type water bomb against a nesting section connected by way of an exit tube to a discharge orifice at a gun barrel end. The pressurized water in the expandable bladder may be released by pulling a pinch trigger.

20 Claims, 5 Drawing Sheets

CARTRIDGE-TYPE WATER BOMB WATER GUN CONVERSION DEVICE

REFERENCE TO RELATED APPLICATION

This application is a Continuation-In-Part of currently pending U.S. patent application Ser. No. 08/272,091, filed on Jul. 8, 1994 and entitled "Toy Water Bomb Device" by the inventor herein, and is a Continuation-In-Part of currently pending U.S. patent application Ser. No. 08/318,138, filed on Oct. 5, 1994 and entitled "Water Bomb Mounted Water Gun" by the inventor herein.

BACKGROUND OF THE INVENTION

1. Field of the Invention

The present invention relates to a water gun which converts a self dischargeable cartridge type water bomb to a pressurized water reservoir for discharge from the water gun.

2. Information Disclosure Statement

Water guns and water toys have been popular with children for decades. The following patents are representative of toys and other devices which utilize bladders for containing and subsequently expelling water or involve water bomb type toys:

U.S. Pat. No. 5,288,256 to Lee et al. describes a thrown water propelling and dispensing toy. The thrown toy has a water tank with valves which are opened by centrifugal force. When thrown, the toy is designed to whirl so that the centrifugal force opens a valve and water is dispersed out the valves while the toy is in flight.

U.S. Pat. No. 4,991,847 to Rudell et al. describes a timed water release toy. There is disclosed a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. The timer is activated and the ball is used in a game in which it is tossed between participants who seek to avoid becoming wet when the timer releases the water from the interior closure of the ball.

U.S. Pat. No. 4,890,838 to Rudell et al. describes a timed water release toy. There is disclosed a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. The timer is activated and the ball is used in a game in which it is tossed between participants who seek to avoid becoming wet when the timer releases the water from the interior closure of the ball.

U.S. Pat. No. 4,854,480 to Shindo describes a long range trigger-actuated squirt gun. The squirt gun includes a hollow housing in the form of a gun with a liquid dispensing assembly within the housing. The liquid dispensing assembly includes a rubber tube, expandable upon being filled with liquid, which is connected to a rigid tube with a nozzle at one end, and will dispense liquid from the rubber tube through the nozzle. A pivotable trigger is mounted with one end located to squeeze the rubber tube against the housing. A rigid coil around the rubber tube between the trigger and rigid tube restrains the rubber tube from expansion for the length of the coil. An adapter is provided which is threadable on a faucet, for filling the rubber tube in the squirt gun with water.

U.S. Pat. No. 4,735,239 to Salmon et al. describes a liquid projecting device. The device uses an elastic tubular bladder for receiving liquid which is expandable radially generally spherically at a local segment until a fully-expanded cross-section is achieved at which time the expanded region begins to grow axially, thereby maintaining a relatively constant pressure independent of bladder volume. The device is provided with a nozzle and a valve for controlling and directing the flow of the projected liquid.

U.S. Pat. No. 4,458,830 to Werding describes an appliance for discharging non-compressible liquid, creamy or pasty product under pressure. The container of rigid material comprises an appliance which employs the contractional force of an expanded rubber hose and an expanded product container for the discharge of a medium stored therein. A hollow body of elastic material located in the axis of a product container is provided with a valve at one end through which it is inflated. The shape of the inner walls of the rigid container limits a radial, diagonal-radial and axial expansion of the appliance in a predetermined ratio, whereby the medium acts upon the inflated hollow body in such a way that the volume of the latter decreases, whereby its inner pressure increases and gives it a tendency to expand. If the squeezing pressure exerted by the rubber hose and the product container upon the medium decreases, the hollow body can expand accordingly and thus compensate the loss of contraction pressure.

U.S. Pat. No. 4,257,460 to Paranay et al. describes a water gun. The novel water gun is disclosed herein having a body formed with a central bore opening at its opposite ends to provide a discharge nozzle at one end of the body and a storage compartment or reservoir end at the opposite end of the body. The storage compartment end is adapted to releasably hold the end of an inflatable member which when loaded with water under pressure, expands so as to stretch the membrane of the inflatable storage compartment. Upon termination of the loading pressure, the inflatable member collapses under its own elasticity to discharge the stored water via the nozzle end of the body. A clamping device is employed for detachably connecting the inflatable storage compartment to its respective end of the body and a trigger mechanism may be employed for selectively releasing the pressurized water within the storage compartment.

U.S. Pat. No. 4,212,460 to Kraft describes a hollow water-filled game toy. The hollow body is provided having two complementary parts releasably joined about interfitting rim portions. When the parts are joined, the hollow body may be compressed to partially deform a portion of the rim structure into an opening thereby allowing the filling of water into the body interior. After deformation the parts resume their original shape. An effective hermetic seal to retain the water within the interior is formed by squeezing the body and purging air through the vents in the rim portions. The water-filled body may then be thrown against a stationary object whereby the force of impact will release the seal and allow the water to become suddenly released causing a splashing action. The complementary hollow parts may be subsequently rejoined and refilled with water to repeat the throwing and splashing action.

U.S. Pat. No. 4,135,559 to Barnby describes a water squirt toy and fill valve combination. The water squirt toy apparatus includes a combination of a water squirt toy and a special filling valve which function together cooperatively. The water squirt toy includes a resiliently expansible tubular member serving as a water reservoir and encased within a rigid tubular support member, and a manually operated, lever-type normally closed valve mechanism operatively associated with the expansible member for permitting or preventing fluid discharge therefrom by compressing or pinching the same. The frontward end of the expansible member is fixedly, but removably, secured to a discharge opening. The filling valve is particularly structured for fluidically mating with a conventional hose bib or hose as well as with the discharge opening in order to permit easy and rapid filling and refilling of the expansible member with water. The discharge opening may also mate directly with the hose bib or hose without the special valve. An injector is also provided for operative connection to the filling valve for injecting chemicals into the water supply whereby the discharged streams will coalesce and exhibit reduced separation so as to be discharged over significantly greater distances; and amusement apparatus which is particularly adaptable for use with the water squirt toy is also disclosed. A weakened annular portion of the tubular member is utilized to insure that the expansion begins frontward and progresses rearwardly.

U.S. Pat. No. 3,486,539 to Candido Jacuzzi describes a liquid dispensing and metering assembly. The liquid dispensing and metering assembly in which an expansible receptacle of a material adapted to maintain constant pressure characteristics over a substantial change in volume of liquid content of such receptacle, discharges through a slow rate metering-element to provide a uniform discharge flow at a low constant pressure.

Notwithstanding the above prior art, there is no teaching or suggestion of obviousness therein respecting the present invention cartridge type water bomb water gun conversion device described herein.

SUMMARY OF THE INVENTION

The present invention is a cartridge-type water bomb water gun conversion device which converts a self dischargeable water bomb into a pressurized water reservoir for release through a water gun. The cartridge-type water bomb has a main housing which includes a frontward portion and a rearward portion rotatably connected to one another and a passageway through both the frontward and rearward portions for receiving a shut off valve. The shut off valve is located within the passageway of the housing and connected to both the frontward and the rearward portions and adapted so that when the frontward and rearward portions are rotated relative to one another, the shut off valve is moved from an open position to a closed position. There is a locking mechanism connected to one of the frontward and rearward portions, and releasably connected to the other portion such that rotation of the frontward portion relative to the rearward portion will move the shut off valve to a closed position and the locking mechanism may then be used to releasably lock the frontward and rearward portions relative to one another to hold the shut off valve in its closed position until subsequently released. There is also an expandable bladder which is filled with liquid and rapidly expends liquid when the device is activated and the valve is opened.

The water gun consists of a gun housing with an engaging lever which accepts the cartridge-type water bomb against a nesting section connected by way of an exit tube to a discharge orifice at a gun barrel end. The pressurized water in the cartridge-type water bomb can be released by partially retracting the engaging lever to open the shutoff valve and pulling a pinch trigger to release a constriction of the exit tube.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

The present invention device is a cartridge-type water bomb water gun conversion device. A component of the conversion device is a water bomb device which may be characterized as a water grenade, a water bomb, water rocket or otherwise. The cartridge-type water bomb's essential feature is that it has a fillable expandable bladder which may be shut off until a release is moved to an open position (e.g. by trigger release) so as to cause a bursting of the water therefrom to simulate a water "explosion" from the water gun. The water bomb device essentially also includes main housing which has a rearward portion and a frontward portion, wherein the frontward portion is rotatable so as to move a shutoff valve from an open position to a closed position for subsequent release thereof. The main housing is connected to an outer shell which may or may not be configured with an internal net for limiting the expansion of the expandable bladder so as to leave an air space for pressurized air.

The water gun is essentially a conversion device comprising a gun housing which can accept and utilize the cartridge-type water bomb device as a water reservoir for discharging a stream of pressurized water through an orifice by way of a trigger controlled mechanism. The water gun consists of a nesting section which mates with the passageway of the cartridge-type water bomb and an engaging lever which firmly seats the discharge outlet of the passageway against the nesting section. The engaging lever may also be configured with a gear teeth rack which also rotates the frontward portion for opening and closing the shutoff valve for subsequent filling and release of pressurized water contained in the expandable bladder.

Figure 1:
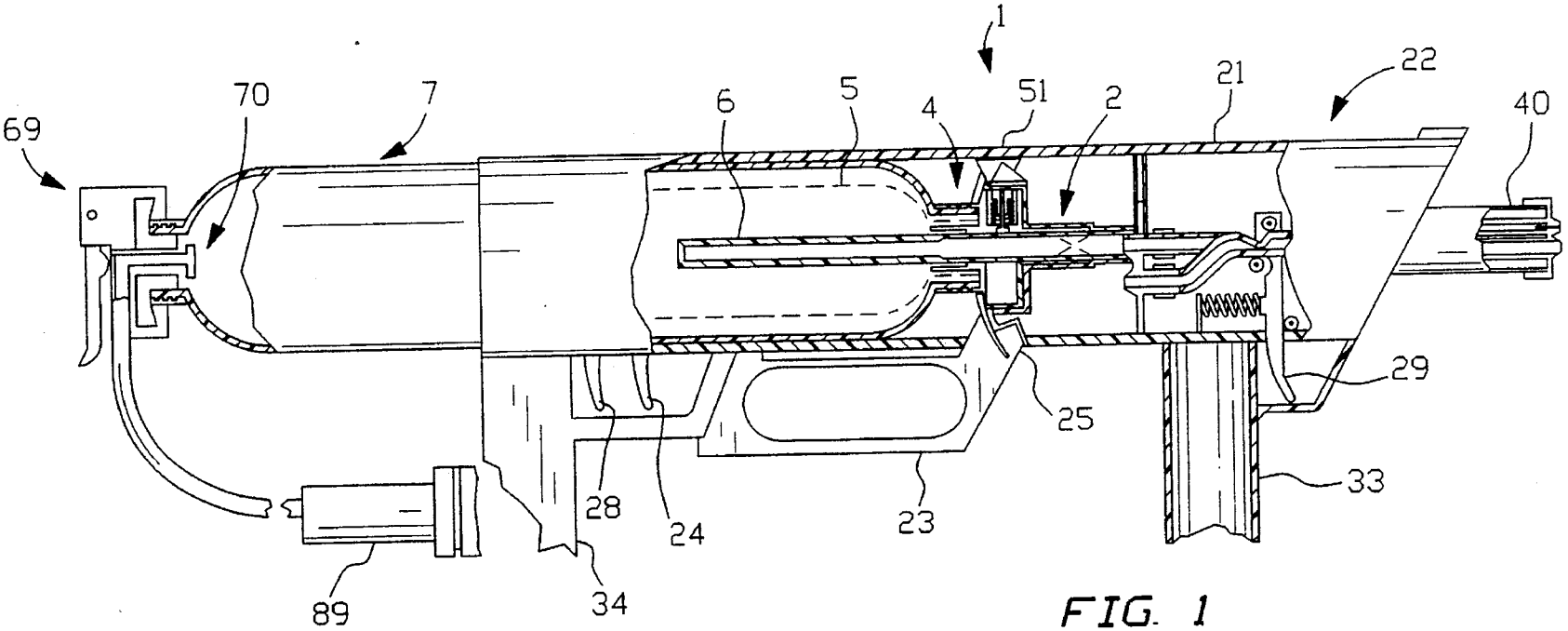
FIG. 1 shows a partially cut side view of a preferred embodiment of a cartridge-type water bomb water gun conversion device.

Referring now to FIG. 1 there is shown a partially cut side view of a cartridge-type water bomb water gun conversion device 1. The device comprises a cartridge-type water bomb 7 inserted into a gun housing 21 of the water gun 22. The remaining reference numbers will be more fully explained in the ensuing figure discussions.

Figure 2:
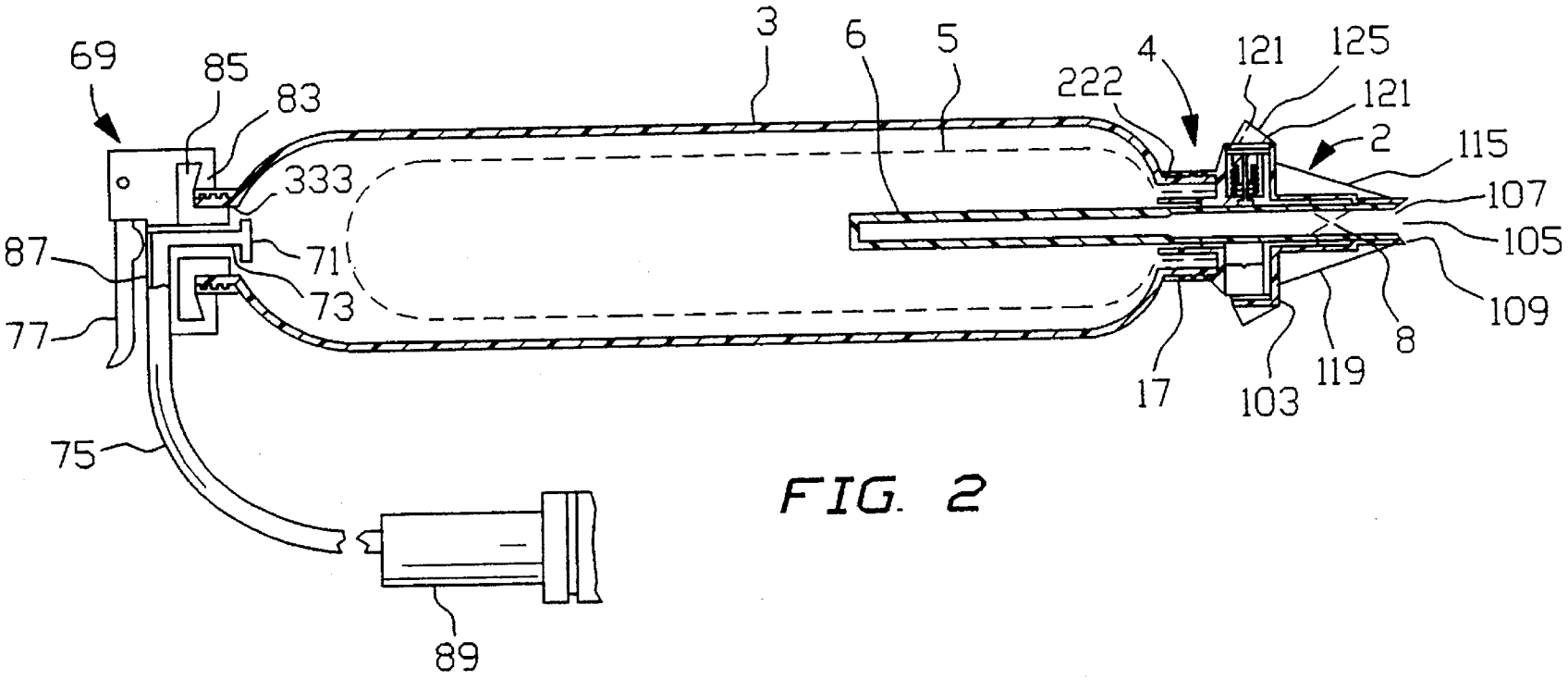
FIG. 2 shows a side cut view of the cartridge-type water bomb in FIG. 1.

Referring now to FIG. 2 there is shown a side cut view of the cartridge-type water bomb 7 removed from the gun housing 21 of the water gun 22. The outer shell 3 has a threaded male end 222 which is connected to a main housing consisting of a frontward portion 2 and rearward portion 4. The other male threaded end 333 is connected to a removable air connection 69. The removable air connection 69 is comprised of a male portion 85 of a quick disconnect type coupling. The male portion 85, whose female threads are mated to threaded male end 333, has in its passageway a one way flow air valve 70 which permits pressurized air into the outer shell 3 cavity but does not let the pressurized air escape from the outer shell 3 cavity. The air check valve 70 is comprised of a one way plunger 71 biased to close against the male portion 85 by a one way spring 73. The female portion 83 of the quick disconnect coupling has pin connected air lever 77 which pushes a right angle inlet tube 87 against the one way plunger 71 to permit pressurized air into the outer shell 3. The pressurized air is supplied by a air pump assembly 89 through hose 75 connected to the right angle tube 87.

In an alternative embodiment, the outer shell 3 may be configured with a closed end in lieu of threaded end 333 and without a removable air connection. In such an embodiment, the force from the expandable bladder's resistance to expansion would expel the water.

Figure 3:
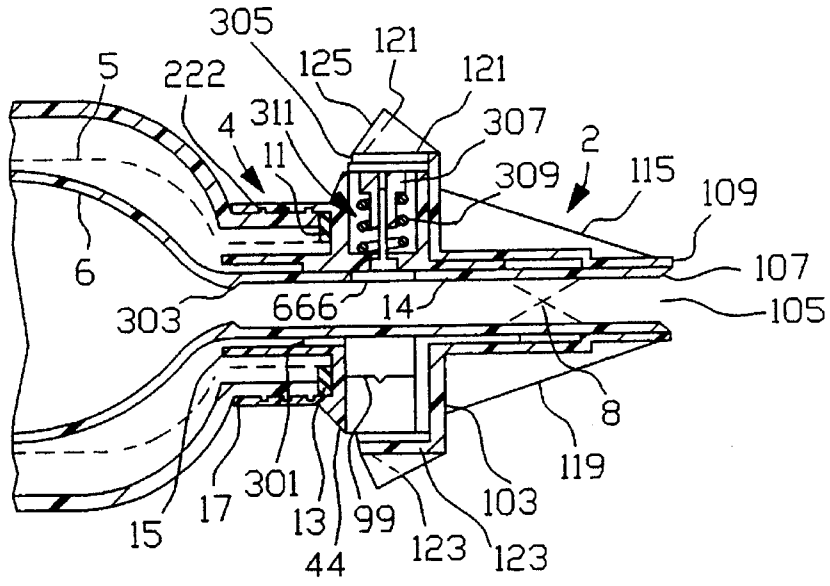
FIG. 3 shows an exploded side cut view of the cartridge-type water bomb in FIG. 1.

Referring now to FIG. 3 there is shown an exploded cut view of the outer shell 3 connected to the rearward portion 4 and frontward portion 2. This cut view is the section line AA' indicated in FIG. 4. The rearward portion 4 consists of a threaded female body portion 17 which is connected to the threaded male end 222 of the outer shell 3 and an upper part which contains a fill inlet 305. The rearward portion 4 is rotatably connected to the frontward portion 2. The rearward portion 4 has fluid seals 11 and 13 where the edge of the male threaded end 222 abuts the innermost edge of the female threaded end 17 to assure a water tight threaded connection. The rearward portion 4 contains a purge vent 301 to allow pressurized air between the outer shell 3 and expandable bladder 6 to escape. When the expandable bladder 6 is filled, it expands and creates an air-tight seal at 15 between the air space and purge vent 301. When fluid is released from a filled expandable bladder 6, the expandable bladder 6 contracts to expose purge vent 301 and allow pressurized air to escape. Escape of the pressurized air through purge vent 301 permits the expandable bladder 6 to be enlarged to maximum capacity by a minimum water supply pressure such as household water supply pressure. Also shown is an optional purge orifice 99 through which the pressurized air can escape and create a "shooting or whistling sound".

The expandable bladder 6 contains a tapered wall 303 which is utilized to insure that the expansion begins frontward and progresses rearwardly when pressurized water is introduced through fill inlet 305. The outer shell 3 limits the expansion of the expandable bladder 6 as pressurized water is introduced. However, an optional net 5 is shown which can be utilized to restrict the enlargement of the expandable bladder 6 so as to leave a predetermined unfilled volume which can be filled with pressurized air from air pump 89 or another external source of pressurized air. The flexible tubing 107 extends through the passageway from the rearward portion 4 and the frontward portion 2 and is fixedly attached to the frontward portion 2 and rearward portion 4. Thus the frontward portion 2 and the rearward portion 4 are rotatably connected to one another and the flexible tube 107 is free to be twisted from the opened position to the closed position to form shut off valve 8 in the passageway. The rearward neck portion 14 keeps the passageway from the rearward portion 4 to frontward portion 2 in axial alignment.

The fill inlet 305 of the rearward portion 4 is an opening to a fluid valve 311 which consists of a one way plunger 307 biased in a closed position by one way spring 309. When the fill inlet 305 is aligned with either fill inlet 121 or 123 of the frontward portion (see FIG. 4) water may be filled into the expandable bladder 6 through opening 666 in the flexible tube 107 by forcing the one way plunger 307 so as to open the fill inlet 305 and opening 666 of the rearward portion 4. In other words, the fill inlet 305 of fluid valve 311 is in internal communication with fill inlet 121 or 123 which can receive a means for supplying pressurized water and the outlet of the fluid valve 311 is in internal communication with the expandable bladder 6 at opening 666. When fluid valve 311 is closed the stopper or bottom portion of the plunger 307 recedes into a slot so that the stopper is even with the inside of flexible tube 107. This receding position of the stopper portion of the plunger 307 minimizes turbulence when pressurized water in the expandable bladder 6 is expelled through the discharge outlet 105 of the passageway.

Figure 4:
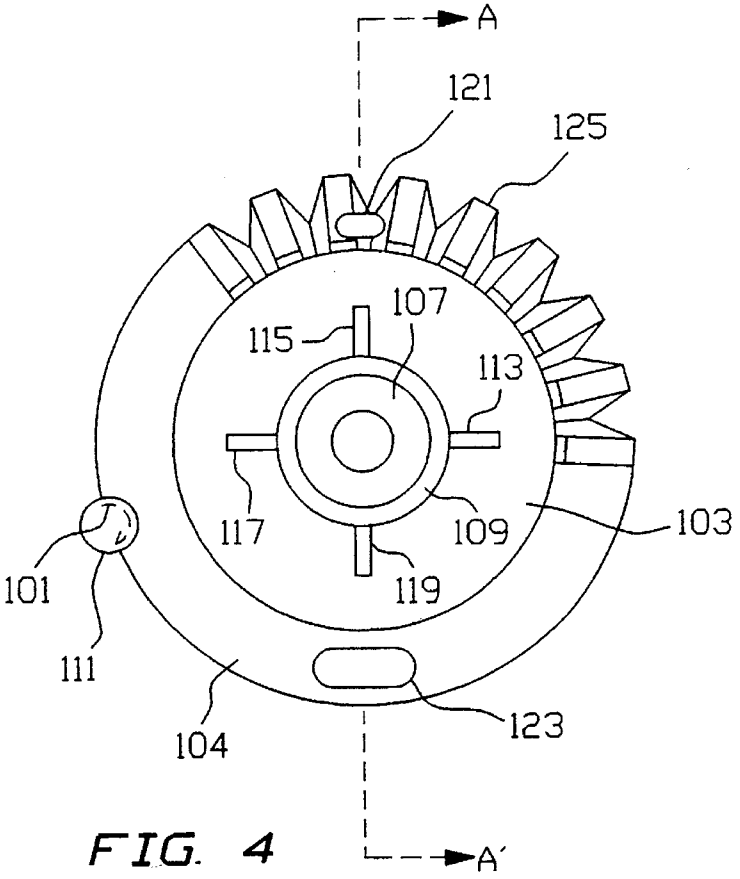
FIG. 4 shows a front view of the cartridge-type water bomb.

FIG. 4 shows a front view of the frontward portion 2 depicted in FIG. 3. Frontward portion 2 has a frontward end surface 103 to which are attached fins 113, 115, 117 and 119. The discharge outlet 105 is through flexible tube 107. The locking cap 111 is shown in a locked position with the corresponding locking stop 101. The frontward end of the flexible tube 107 is fixedly attached to the frontward tube 109 (eg. by being heat sealed, glued, clamped or otherwise). The frontward portion 2 also has a beveled outer perimeter 104 which a portion thereof has helical gear teeth 125 which engage with gear teeth rack 26 on an engaging lever 25 of the water gun 22 (see FIG. 5). Located one hundred eighty degrees apart on the outer perimeter 104 are two fill inlets 121 and 123. When the cartridge-type water bomb 7 is to be used by itself to release a water burst, the fill inlet 123 is used for filling the expandable bladder 6 with water. By rotating the fill inlet 123 so that it aligns with the fill inlet 305, the shut off valve 8 is twisted into a closed position. Therefore, water can be brought into the expandable bladder 6 without trickling through the discharge outlet 105.

When the cartridge-type water bomb 7 is inserted into the water gun 22, the fill inlet 121 is used for filling the expandable bladder 6 with water. When the fill inlet 121 is aligned with the fill inlet 305, the shut off valve 8 is open. Therefore, water flows through the discharge outlet 105 to a pinch point in the water gun 22, which will be discussed more fully in FIG. 5.

Figure 5:
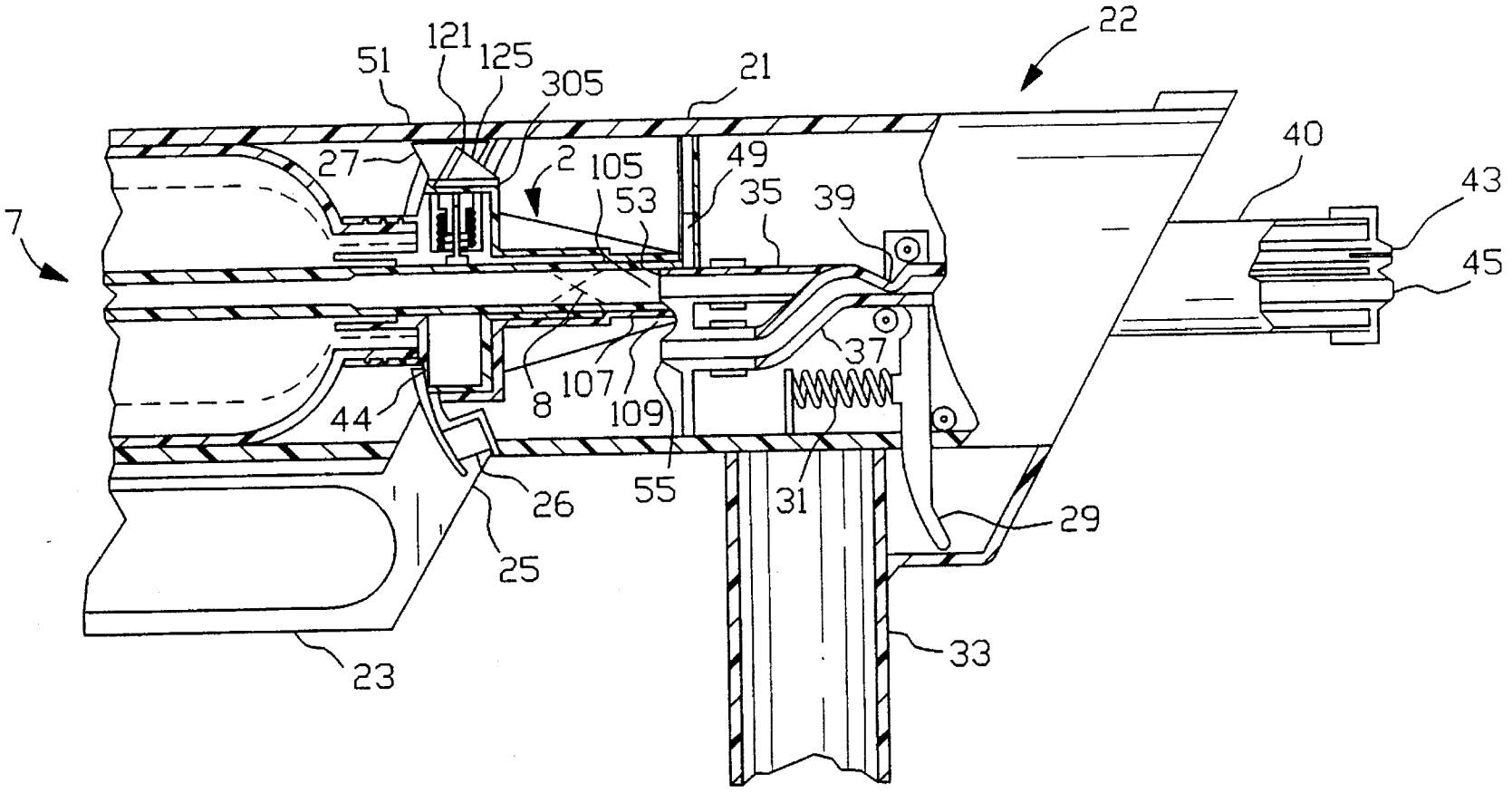
FIG. 5 shows a partially cut side view of the water gun shown in FIG. 1.

A partially cut side view of the water gun 22 with the cartridge-type water bomb 7 inserted is shown in FIG. 5. The water gun 22 consists of a gun housing 21 with a front handle 33, rear handle 34 (see FIG. 1) and gun barrel 40. Inside the water gun 22 are nesting sections 53 and 55 on a slide plate 49 that is vertically positioned to align at least one of the nesting sections 53 and 55 with the discharge outlet 105 of the passageway of frontward portion 2 and rearward portion 4. As shown, nesting section 53 has a protruding orifice with a tapered side which seats inside and against the flexible tubing 107. The nesting section 53 is connected to an exit tube 35 which is connected to a discharge orifice 43 at the gun barrel 40 end. Nesting section 55 is connected to exit tube 37 which is connected to discharge orifice 45 at the gun barrel 40 end. As shown, discharge orifice 43 has a smaller diameter to provide a "squirt" or narrow stream discharge of water, whereas the larger diameter discharge orifice 45 can provide a "burst" or wider stream discharge. A pinch trigger 29 constricts both exit tubes 35 and 37 at pinch point 39 by the force of spring 31. When pressurized water is to be expelled through one of the exit tubes, 35 or 37, the pinch trigger 29 is retracted toward the front handle 33 thereby eliminating or releasing the constriction of an exit tube at pinch point 39.

The cocking lever 23 and engaging lever 25 shown in FIG. 5 are the forwarding means by which the discharge outlet 105 of the passageway of the cartridge-type water bomb 7 is [forwarded or] advanced and fully seated against the nesting section 53. When the cocking lever 23 is fully pulled toward the gun housing 21 the engaging lever 25, by way of the gear teeth rack 26 meshing with the helical gear teeth 125 on the beveled outer perimeter 104 of the frontward portion 2, is also the loading means which by opening shutoff valve 8 allows pressurized water to expel through the nesting section 53 and connected exit tube 35 to the constriction of the exit tube 35 by the pinch trigger 29 at pinch point 39. As described more fully in FIG. 6, in order to open the shut off valve 8, the engaging lever 25 opens the locking means 10, thereby allowing the twisted flexible tube 107 to untwist and open the shut off valve 8. To illustrate, with the cocking lever 23 fully retracted, the cartridge-type water bomb 7 is inserted into the gun housing 21 so that the discharge outlet 105 is against the mating nesting section 53. The cocking lever 23 is then rotated partially toward the gun housing 21 to cause the tapered lead in edge 27 of the engaging lever 25 to contact the radius cam edge 44 of rearward portion 4. As the cocking lever 23 continues to be rotated towards the gun housing 21, the lead in edge 27 passes the horizontal centerline of the rearward portion 4 and radius cam edge 44, thus providing maximum forward motion of the cartridge-type water bomb 7 and firmly seating the flexible tube 107 against the nesting section 53. Moreover, as the lead in edge 27 passes the horizontal centerline of the rearward portion 4, the gear teeth rack 26 begins to mesh with the helical gear teeth 125 and the frontward portion 2 is rotated so as to rotate shutoff valve 8 from a closed position to an open position. When the cocking lever 23 has been completely pulled toward the gun housing 21, the frontward portion 2 has rotated one hundred eighty degrees and shutoff valve 8 has been fully opened. When fill inlets 121 and 305 are aligned with gun housing fill inlet 51, pressurized water may then be introduced to the expandable bladder 6 with a fill mechanism (see 18 FIG. 7). When the pinch trigger 29 is pulled toward the front handle 33 the constriction at pinch point 39 is removed and the pressurized water flows through exit tube 35 and out through discharge orifice 43.

In an alternative embodiment the water gun 22 may comprise only one nesting section and one exit tube as opposed to the two nesting sections and two exit tubes depicted in FIG. 5. Moreover, in other embodiments the engaging lever 25 may be configured without a gear teeth rack 26 so that the engaging lever only advances the discharge outlet 105 of the frontward portion 2 against the nesting section 53. Consequently, the shut off valve 8 may be locked by locking cap 111 which in turn may be released by bomb trigger 24 (see FIG. 6). In a further alternative embodiment, the cocking lever 23 may be connected to the pinching trigger 29 by linkages so as to release the constriction of exit tube 35 at pinch point 39 when the cocking lever is fully retracted. In another variation the pinch trigger 29 may be simply for appearances sake with no constriction of the exit tube 35, whereby expulsion of water from the expandable bladder 6 through the discharge orifice 43 may be controlled by only the cocking lever 23 opening the shut off valve 8.

Figure 6:
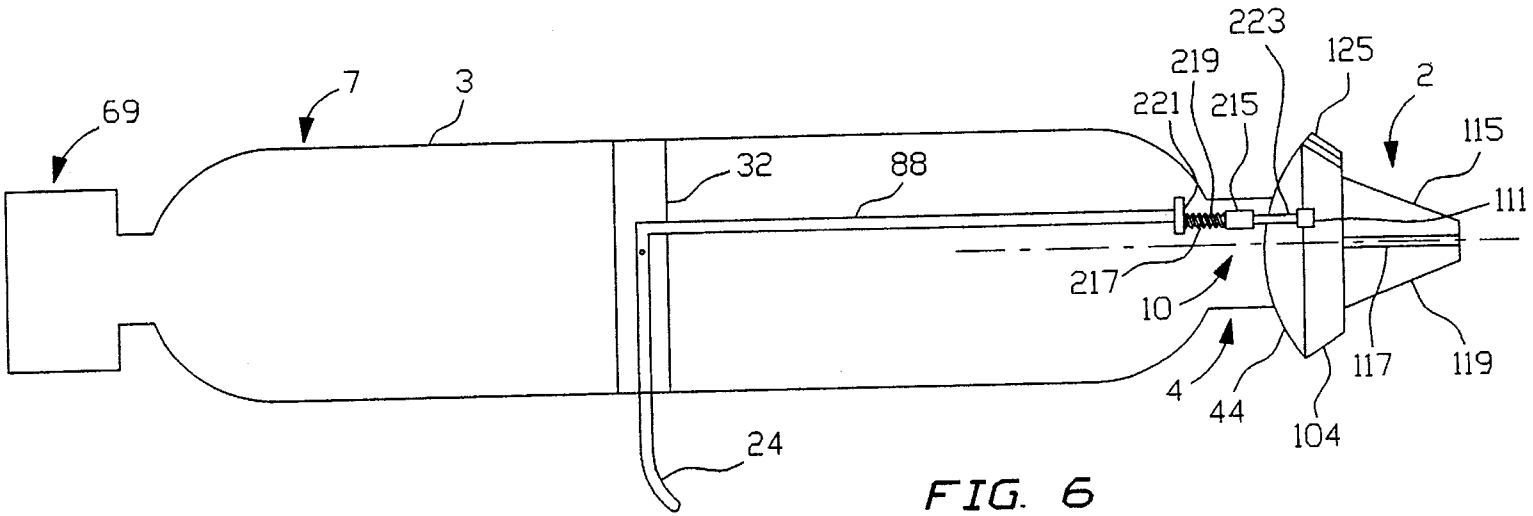
FIG. 6 shows a side view of the cartridge-type water bomb trigger mechanism.

FIG. 6 illustrates a side view detailing a discharge mechanism when the cartridge-type water bomb 7 may be used by itself to release a water burst. Bomb trigger 24 is pivotally connected to band 32 which slips over the outer shell 3. The bomb trigger 24 has a unistructurally formed horizontal push rod 88 which releases locking means 10 when the bomb trigger is pulled away from the frontward portion 2 end. The illustrated locking means 10 includes a locking cap 111 which is attached to locking pin 219 which in turn is attached to locking end 221. The locking cap 111 is biased against the beveled outer perimeter 104 of the frontward portion 2 by locking spring 217. The locking pin 219 slides a limited distance through the locking retainer 215 when the locking cap 111 is aligned with the locking stop 101 (see FIG. 4). The locking retainer 215 may be removably or permanently connected to the rearward portion 4. The extended tab 223 is fixedly connected to locking pin 219 between the locking cap 111 and locking retainer 215. In a typical operation, the bomb trigger 24 is pulled so that locking cap 111 extends beyond the beveled outer perimeter 104 allowing frontward portion 2 to be rotated. Once the frontward portion 2 is rotated till flexible tube 107 is twisted to effect shut off valve 8 into a closed configuration the bomb trigger is released allowing locking cap 111 to recede into locking stop 101 (see FIG. 4). To effect a water burst discharge the bomb trigger 24 is pulled to push the locking cap 111 out of the locking stop 101, thereby allowing the twisted flexible tube 107 to untwist and open the shut off valve 8. The bomb trigger 24 and band 32 may be removed when the cartridge-type water bomb is inserted into the gun housing 21 for use as a reservoir for operation of the water gun 22. For water gun 22 operation, as the cocking lever 23 is pulled toward the gun housing 21, the lead in edge 27 of the engaging lever 25 contacts and pushes the extended tab 223 so as to push locking cap 111 out of the locking stop 101, thereby allowing the twisted flexible tube 107 to untwist and open the shutoff valve 8. In other words, when the cocking lever 23, as the forwarding means, is fully pulled toward the gun housing, the engaging lever 25, as the loading means, also releases the locking means 10. FIG. 1 also shows an optional bomb trigger 24 which is for an alternative embodiment of a cartridge-type water bomb water gun conversion device 1 which can accept two cartridge-type water bombs, thereby doubling the water reservoir capacity for operation of the water gun 22. Bomb triggers 24, 28 are used for firing each cartridge-type water bomb.

Figure 7:
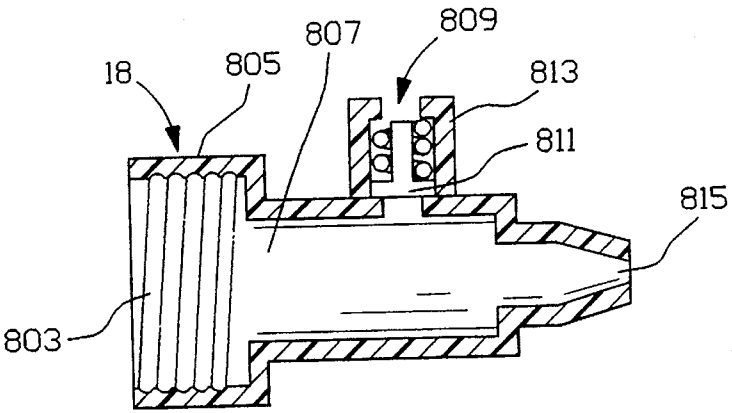
FIG. 7 shows a cross sectional view of a filling mechanism useful in the present invention cartridge-type water bomb water gun conversion device.

Referring to both FIGS. 1, 2, 3, 4, 5, 6 and 7, there is shown in FIG. 7 a filling mechanism 18 having a female end 805 with threads 803 adapted to be attached to a standard garden hose or an outdoor threaded faucet. It has a main chamber 807 with a side water pressure release valve 809 which includes a spring 813 and a plunger valve 811. There is an outlet 815 which is adapted to fit into the discharge outlet 105 of the cartridge-type water bomb 7, inlet openings 121, 123 of the frontward portion 2 and 305 of the rearward portion 4, and the gun housing fill inlet 51. This filling mechanism 18 is inserted as indicated, after it has been attached to a garden hose or faucet or otherwise, water is released by opening a valve or faucet and the water expands the expandable bladder 6, so as to completely fill up the volume of the outer shell 3 or the optional net 5.

The cartridge-type water bomb water gun conversion device can be made in a variety of configurations. The gun housing can be reconfigured to accept two or more cartridge-type water bombs. When there are two or more cartridge-type water bombs, there are a plurality of bomb triggers 24, 28 (see FIG. 1) in which each trigger 24, 28 fires a corresponding cartridge-type water bomb. Alternatively, the pinch trigger 29 can be eliminated leaving only the cocking lever 23 to control expulsion of water from the expandable bladder 6 through discharge orifice 43. Alternatively, the cocking lever 23 may be configured with an engaging lever 25 without a gear teeth rack 26. Consequently, the cocking lever 26 would function to only firmly seat or lock the discharge outlet 105 of the passageway of the frontward portion 2 against the nesting section. Expulsion of water from the expandable bladder 6 would then be controlled by the pinch trigger 29.

Obviously, numerous modifications and variations of the present invention are possible in light of the above teachings. For example, while the present invention device is developed and designed to utilize a cocking lever 23 that both firmly seats the discharge outlet 105 against a nesting section 53 and rotates the frontward portion 2 for alignment with gun housing fill inlet 51, in an alternative embodiment the cocking lever may only firmly seat the discharge outlet 105 requiring that the frontward portion 2 be properly aligned with fill inlet 51 by hand. In other words, before insertion into the gun housing, the frontward portion 2 can be manually rotated to properly align fill inlet openings 121, 123 of the frontward portion 2 with fill inlet 305 of the rearward portion 4 and gun housing fill inlet 51. During this hand alignment procedure the shutoff valve 8 would be rotated to an open condition allowing any subsequently filled fluid in the expandable bladder 6 to be released by the pinch trigger 29. Such an embodiment would eliminate the need for a gear teeth rack 26 on the engaging lever 25 and render a simpler design not requiring a meshing gear teeth rack 26. Also, for example, it is possible to utilize other types of valves in place of the fluid one way valve (check valve) 311 or the air one way valve or check (valve) 70. Further, any of numerous locking means can be utilized to releasably lock the frontward portion 2 to the rearward portion 4 which can be released by a number of alternatives to the water bomb release trigger. The locking means 10 may be also be released by a timing mechanism. The timing mechanism would be a set of gears and a spring which would operate like a clock for a chess game, an egg timer, or any other internal mechanism. These spring loaded winding, timing mechanisms are well within the skill of the artisan although not in the context of the present invention.

It is therefore understood that within the scope of the appended claims, the invention may be practiced otherwise than as specifically described herein.

What is claimed is:

1. A cartridge-type water bomb water gun conversion device, comprising:

(a) a cartridge-type water bomb, comprising:

(1) a main housing having a frontward portion and a rearward portion rotatably connected to one another and having a passageway with a discharge outlet through both of said frontward portion and rearward portion for receiving a shut off valve;

(2) a shut off valve located within said passageway of said main housing and connected to said frontward portion and said rearward portion of said main housing and adapted so that when said frontward portion and said rearward portion of said main housing are rotated relative to one another, said shut off valve is moved from an open position to a closed position;

(3) a locking means connected to one of said frontward portion and said rearward portion of said main housing and releasably connected to the other of said frontward portion and said rearward portion of said main housing such that said frontward portion may be rotated relative to said rearward portion to move said shut off valve to a closed position and said locking means may then be used to releasably lock said frontward portion and said rearward portion relative to one another to hold said shut off valve in its closed position until subsequently released; and, (4) an expandable bladder connected to said rearward portion of said main housing so that fluid may pass through said shut off valve in the open position and expand said expandable bladder to a predetermined volume of fluid, said frontward portion of said main housing may be rotated relative to said rearward portion so as to move said shut off valve to its closed position, and said locking means may then lock said frontward portion with said rearward portion, with said expandable bladder filled and said shutoff valve in its closed position, whereby said locking means may be subsequently released such that said expandable bladder filled with fluid will rapidly contract and expel fluid through said shut off valve to simulate a water explosion;

wherein said cartridge-type water bomb may be used by itself to be released and generate a water burst, and, alternatively, may be mounted on a water gun for multiple firings by trigger action;

(b) a water gun comprising:

(1) a gun housing;

(2) a nesting section inside and attached to said gun housing, said nesting section for receiving said cartridge-type water bomb;

(3) a gun barrel extending outwardly form said gun housing;

(4) an exit tube and discharge orifice on said gun barrel, said exit tube being connected to said nesting section on one end and connected to said discharge orifice on the other end; and, (4) a pinch trigger movably connected to said gun housing of said water gun and functionally connected to said exit tube so as to have a first, closed position wherein said exit tube is pinched closed, and a second, open position caused by activation of said trigger wherein said exit tube is open.

2. The device of claim 1 wherein said cartridge-type water bomb further includes an outer shell attached to said rearward portion of said main housing and surrounding said expandable bladder and having a predetermined volume so as to limit the maximum expansion of the bladder.

3. The device of claim 1 wherein said cartridge-type water bomb further includes a fluid valve having an inlet and an outlet, located in the rearward portion of said main housing, the inlet of said fluid valve capable of being in internal fluid communication with a fill inlet adapted to receive a means for supplying pressurized water, the outlet of said fluid valve in internal fluid communication with said expandable bladder.

4. The device of claim 2 wherein said water gun includes means for releasably locking said cartridge-type water bomb to said nesting section of said gun housing.

5. The device of claim 1 wherein said water gun includes forwarding means for advancing said cartridge-type water bomb against said nesting section in a direction toward said exit tube to enhance connection of said cartridge-type water bomb to said nesting section.

6. The device of claim 1 wherein said water gun includes loading means for opening said locking means of said cartridge-type water bomb and consequently for opening said shut off valve of said cartridge water bomb after said cartridge-type water bomb has been mounted in said nesting section and has been connected to said exit tube.

7. The device of claim 5 wherein said forwarding means includes a cocking lever located on said gun housing and an engaging lever connected to said cocking lever which advances said cartridge-type water bomb when said cocking lever is pulled toward said gun housing.

8. The device of claim 5 wherein said water gun includes loading means for opening said shutoff valve of said cartridge-type water bomb after said cartridge-type water bomb has been mounted in said nesting and has been connected to said exit tube.

9. The device of claim 8 wherein said forwarding means includes a cocking lever located on said housing and an engaging lever connected to said cocking lever which advances said cartridge-type water bomb when said cocking lever is pulled toward said gun housing.

10. The device of claim 1 wherein said cartridge-type water bomb further includes a separate fill mechanism having an inlet which is attachable to a threaded faucet, a pressure relief valve set to open at a predetermined pressure and an insertable outlet adapted to fit into the discharge outlet of the passageway of the main housing.

11. The device of claim 2 wherein said cartridge-type water bomb further includes a net inside said outer shell attached to said rearward portion of said main housing and surrounding said expandable bladder and having a predetermined volume to limit the maximum expansion of said expandable bladder so as to leave a remaining predetermined volume between said expandable bladder and said outer shell for receiving pressurized air when said expandable bladder is filled with fluid.

12. The device of claim 11 wherein said cartridge-type water bomb further includes a fluid valve having an inlet and an outlet, located in the rearward portion of said main housing, the inlet of said fluid valve capable of being in internal fluid communication with a fill inlet adapted to receive a means for supplying pressurized water, the outlet of said fluid valve in internal fluid communication with said expandable bladder.

13. The device of claim 11 wherein said water gun includes means for releasably locking said cartridge-type water bomb to said nesting section of said gun housing.

14. The device of claim 11 wherein said water gun includes forwarding means for advancing said cartridge-type water bomb against said nesting section in a direction toward said exit tube to enhance connection of said cartridge-type water bomb to said nesting section.

15. The device of claim 14 wherein said forwarding means includes a cocking lever located on said gun housing and an engaging lever connected to said cocking lever which advances said cartridge-type water bomb when said cocking lever is pulled toward said gun housing.

16. The device of claim 11 wherein said water gun includes loading means for opening said locking means of said cartridge-type water bomb and consequently for opening said shut off valve of said cartridge-type water bomb after said cartridge-type water bomb has been mounted in said nesting section and has been connected to said exit tube.

17. The device of claim 16 wherein said loading means includes an engaging lever having a gear teeth rack, said engaging lever being connected to a cocking lever which rotates said frontward portion of said cartridge-type water bomb and opens said shutoff valve when said cocking lever is fully pulled toward said gun housing; said gear teeth rack meshing with helical gear teeth located on an outer perimeter of said frontward portion of said main housing.

18. The device of claim 15 wherein said water gun further includes loading means for opening said locking means of said cartridge-type water bomb and consequently, for opening said shut off valve of said cartridge-type water bomb after said cartridge-type water bomb has been mounted against said nesting section and has been connected to said exit tube.

19. The device of claim 18 wherein said loading means includes an engaging lever having a gear teeth rack, said engaging lever being connected to cocking lever which rotates said frontward portion of said cartridge-type water bomb and opens said shutoff valve when said cocking lever is completely pulled toward said gun housing; said gear teeth rack meshing with helical gear teeth located on an outer perimeter of said frontward portion of said main housing.

20. The device of claim 11 wherein said cartridge-type water bomb gun further includes a one way air valve for introducing pressurized air to said remaining predetermined volume between said expandable bladder and said outer shell.

* * * * *